US008826680B2

(12) United States Patent
Crane et al.

(10) Patent No.: US 8,826,680 B2
(45) Date of Patent: Sep. 9, 2014

(54) PRESSURE RATIO UNLOAD LOGIC FOR A COMPRESSOR

(75) Inventors: Curtis C. Crane, York, PA (US); Martin L. Doll, Jr., York, PA (US); Glenn E. Nickey, New Oxford, PA (US)

(73) Assignee: Johnson Controls Technology Company, Holland, MI (US)

( * ) Notice: Subject to any disclaimer, the term of this patent is extended or adjusted under 35 U.S.C. 154(b) by 1801 days.

(21) Appl. No.: 11/421,078

(22) Filed: May 31, 2006

(65) Prior Publication Data

US 2007/0144193 A1 Jun. 28, 2007

Related U.S. Application Data

(60) Provisional application No. 60/754,242, filed on Dec. 28, 2005.

(51) Int. Cl.
*F25B 13/00* (2006.01)
*F25B 49/02* (2006.01)

(52) U.S. Cl.
CPC ..... *F25B 49/022* (2013.01); *F25B 2500/19* (2013.01); *F25B 2700/1931* (2013.01); *F25B 2700/1933* (2013.01)
USPC ..... 62/228.3; 62/228.5

(58) Field of Classification Search
USPC ..... 62/228.3, 228.5, 208, 209
See application file for complete search history.

(56) References Cited

U.S. PATENT DOCUMENTS 1,584,870 A * 5/1926 Lagergren ..... 62/181
4,326,387 A * 4/1982 Friedman ..... 62/184
4,412,788 A 11/1983 Shaw et al.
4,439,997 A * 4/1984 Cantley ..... 62/175
4,459,817 A 7/1984 Inagaki et al.
4,594,858 A * 6/1986 Shaw ..... 62/175
4,751,866 A 6/1988 Blake
4,762,467 A 8/1988 Ackermann et al.
4,848,096 A * 7/1989 Funahashi et al. ..... 62/126
5,086,624 A * 2/1992 Matsuoka et al. ..... 62/160
5,169,294 A * 12/1992 Barito ..... 417/310
5,306,116 A 4/1994 Gunn et al.
5,570,585 A * 11/1996 Vaynberg ..... 62/175
5,613,841 A 3/1997 Bass et al.
6,041,605 A 3/2000 Heinrichs
6,139,280 A 10/2000 Holt et al.
6,301,911 B1 10/2001 Reason et al.

(Continued)

FOREIGN PATENT DOCUMENTS

EP 0545847 A1 6/1993

*Primary Examiner* — Ljiljana Ciric
*Assistant Examiner* — Alexis Cox
(74) *Attorney, Agent, or Firm* — NcNees Wallace & Nurick LLC

(57) ABSTRACT

A method is disclosed for controlling a discharge pressure of a compressor relative to a suction pressure of the compressor. The discharge pressure and suction pressure of the compressor are monitored and compared with a predetermined maximum pressure ratio of discharge pressure to suction pressure. If the pressure ratio of discharge pressure to suction pressure exceeds a predetermined pressure ratio limit less than the maximum pressure ratio, a controller unloads the compressor. The predetermined pressure ratio limit is determined relative to the measured suction pressure. The discharge pressure and suction pressure are further monitored and the compressor is inhibited from being reloaded for a predetermined time delay. After the predetermined time delay has elapsed, the compressor is reloaded only if i) the discharge pressure falls below a predetermined reload pressure and ii) the chiller system requires additional cooling capacity.

20 Claims, 3 Drawing Sheets

(56) References Cited

U.S. PATENT DOCUMENTS

| | | | | |
|---|---|---|---|---|
| 6,457,948 | B1 | 10/2002 | Pham | |
| 6,691,525 | B2 * | 2/2004 | Beaverson et al. | 62/196.3 |
| 7,612,510 | B2 * | 11/2009 | Koehl | 318/400.21 |
| 7,617,695 | B2 * | 11/2009 | Shapiro | 62/228.5 |
| 7,624,583 | B2 * | 12/2009 | Yoshimi et al. | 62/84 |
| 2001/0013225 | A1 * | 8/2001 | Ota et al. | 62/228.5 |
| 2006/0075771 | A1 * | 4/2006 | Tracey et al. | 62/506 |
| 2006/0236708 | A1 * | 10/2006 | Mizuno et al. | 62/228.3 |
| 2009/0120113 | A1 * | 5/2009 | Takegami et al. | 62/228.3 |
| 2009/0282849 | A1 * | 11/2009 | Fujimoto et al. | 62/228.5 |
| 2010/0161134 | A1 * | 6/2010 | Takahashi | 700/276 |

* cited by examiner

PRESSURE RATIO UNLOAD LOGIC FOR A COMPRESSOR

CROSS-REFERENCES TO RELATED APPLICATIONS

This patent application claims the benefit of U.S. Provisional Application No. 60/754,242 filed Dec. 28, 2005.

FIELD OF THE INVENTION

The present invention relates generally to a control system and method for a refrigeration or air conditioning system. Specifically, the present invention relates to a system and method for controlling the unloading and loading of a compressor system that attempts to operate above its maximum pressure ratio.

BACKGROUND OF THE INVENTION

In a typical refrigeration system, the compressor operates within a range of acceptable pressure ratios. The pressure ratio is defined as the ratio of compressor discharge pressure to suction pressure. In a compressor operating in normal mode, i.e., with no capacity unloading devices activated, the relationship between discharge pressure and suction pressure is linear. The maximum pressure ratio is determined by the compressor manufacturer. Operating the compressor above the maximum pressure ratio can cause damage to the compressor and other system components, or may cause a safety shutdown resulting in a total loss of cooling provided by the system.

Therefore, what is needed is a control algorithm that can determine when a compressor in a refrigeration system is operating at or above its maximum pressure ratio, and can promptly unload the compressor to avoid damage to the system, without shutting down the system. What is further needed is a control algorithm to unload a compressor that has reached a maximum pressure ratio, while continuing operation of the compressor and then to reload the compressor to respond to capacity demand only after the pressure ratio has stabilized.

SUMMARY OF THE INVENTION

One embodiment of the present invention is directed to a method for controlling a discharge pressure of a compressor relative to a suction pressure of the compressor. The method includes the steps of measuring a discharge pressure and a suction pressure of the compressor; determining a compressor pressure ratio using the measured discharge pressure and the measured suction pressure; comparing the determined pressure ratio with a predetermined maximum pressure ratio of discharge pressure to suction pressure, wherein the predetermined maximum pressure ratio is less than a maximum rated pressure ratio for the compressor; and unloading the compressor in response to the determined pressure ratio exceeding the predetermined maximum pressure ratio.

The disclosed method of the present invention further includes the steps of further monitoring the discharge pressure and suction pressure; inhibiting the compressor from being reloaded for a predetermined time delay; and reloading the compressor after the predetermined time delay has elapsed, in response to the discharge pressure falling below a predetermined reload pressure and the chiller system requiring additional cooling capacity.

In another aspect of the invention, there is disclosed a method for controlling the discharge pressure of a compressor in a chiller system. The chiller system includes a compressor, a condenser, and an evaporator connected in a closed refrigerant loop. Also, a control panel is provided for controlling the operation of the system. The method of controlling the discharge pressure of the compressor includes the steps of: providing a set of maximum compressor discharge pressure values for corresponding suction pressure values, wherein the maximum compressor discharge pressure value is less than a maximum rated discharge pressure value for a corresponding suction pressure value; determining a compressor suction pressure; determining a compressor discharge pressure; unloading the compressor for at least a predetermined interval when the determined compressor discharge pressure is greater than the maximum compressor discharge pressure for the determined compressor suction pressure; initiating a compressor reloading process in response to unloading the compressor and receiving a demand for capacity. The compressor reloading process includes the steps of: providing a set of compressor reload discharge pressure values for corresponding compressor suction pressure values; waiting a predetermined interval; determining an unloaded compressor discharge pressure and an unloaded compressor suction pressure after unloading the compressor; comparing the compressor reload discharge pressure value with the determined unloaded compressor discharge pressure for the determined unloaded compressor suction pressure; waiting another predetermined interval when the determined unloaded compressor discharge pressure is greater than the reload pressure value for the determined unloaded compressor suction pressure; and reloading the compressor when the determined unloaded compressor discharge pressure is less than or equal to the reload pressure value for the determined unloaded compressor suction pressure.

In another aspect of the invention, there is a computer program product implemented on a computer readable medium and executable by a microprocessor for determining when to unload a compressor in a chiller system. The computer program product includes computer instructions for executing the steps of: measuring a discharge pressure and a suction pressure of the compressor; determining a compressor pressure ratio using the measured discharge pressure and the measured suction pressure; comparing the determined pressure ratio with a predetermined maximum pressure ratio of discharge pressure to suction pressure, wherein the predetermined maximum pressure ratio is less than a maximum rated pressure ratio for the compressor; and unloading the compressor in response to the determined pressure ratio exceeding the predetermined maximum pressure ratio.

Finally, the computer program product includes instructions for executing the steps of further monitoring the discharge pressure and suction pressure, inhibiting the compressor from being reloaded for a predetermined time delay, and reloading the compressor after the predetermined time delay has elapsed, in response to the discharge pressure falling below a predetermined reload pressure; and the chiller system requiring additional cooling capacity One advantage of the present invention is that the system automatically prevents the compressor from running above the maximum pressure ratio that is recommended by the compressor manufacturer, and prevents damage to the compressor that may be caused by exceeding the recommended maximum pressure ratio.

Another advantage of the present invention is the reduction in safety shutdowns and in total loss of cooling in the chiller system, caused by exceeding the recommended maximum pressure ratio of the compressor.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
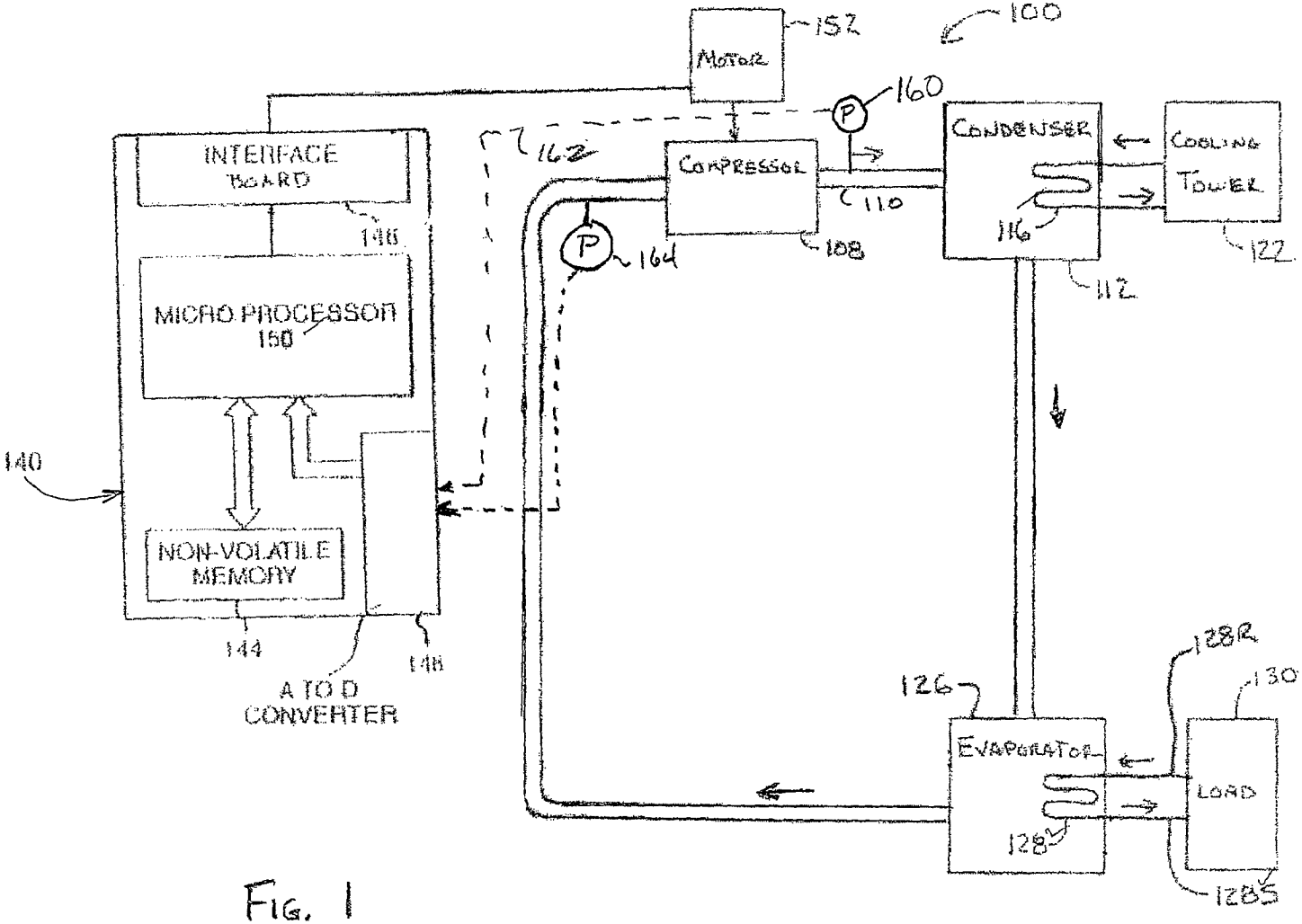
FIG. 1 illustrates schematically a refrigeration system of the present invention.

A general refrigeration system to which the invention can be applied is illustrated, by means of example, in FIG. 1. As shown, the HVAC, refrigeration or liquid chiller system 100 has a single compressor, but it is to be understood that the system 100 can have more than one compressor for providing the desired system load. The system 100 includes a compressor 108, a condenser 112, a water chiller or evaporator 126, and a control panel 140. The control panel 140 can include an analog to digital (A/D) converter 148, a microprocessor 150, a non-volatile memory 144, and an interface board 146. The operation of the control panel 140 will be discussed in greater detail below. The conventional HVAC, refrigeration or liquid chiller system 100 includes many other features that are not shown in FIG. 1. These features have been purposely omitted to simplify the drawing for ease of illustration.

In a single compressor embodiment, the compressor 108 compresses a refrigerant vapor and delivers it to the condenser 112. The compressor 108 is preferably a scroll compressor, however the compressor can be any suitable type of compressor including screw compressors, reciprocating compressors, centrifugal compressors, rotary compressors or other type of compressor. The refrigerant vapor delivered to the condenser 112 enters into a heat exchange relationship with a fluid, preferably water, flowing through a heat-exchanger coil 116 connected to a cooling tower 122. The refrigerant vapor in the condenser 112 undergoes a phase change to a refrigerant liquid as a result of the heat exchange relationship with the fluid in the heat-exchanger coil 116. The condensed liquid refrigerant from condenser 112 flows through an expansion device to an evaporator 126.

The evaporator 126 can include a heat-exchanger coil 128 having a supply line 128S and a return line 128R connected to a cooling load 130. The heat-exchanger coil 128 can include a plurality of tube bundles within the evaporator 126. A secondary liquid, which is preferably water, but can be any other suitable secondary liquid, e.g. ethylene, calcium chloride brine or sodium chloride brine, travels into the evaporator 126 via return line 128R and exits the evaporator 126 via supply line 128S. The liquid refrigerant in the evaporator 126 enters into a heat exchange relationship with the liquid in the heat-exchanger coil 128 to chill the temperature of the liquid in the heat-exchanger coil 128. The refrigerant liquid in the evaporator 126 undergoes a phase change to a refrigerant vapor as a result of the heat exchange relationship with the liquid in the heat-exchanger coil 128. The vapor refrigerant in the evaporator 126 then returns to the compressor 108 to complete the cycle. While the above fluid flow configurations of the refrigerant and other fluids in the condenser 112 and evaporator 126 are preferred, it is to be understood that any suitable fluid flow configuration for the condenser 112 and evaporator 126 can be used for the exchange of heat with the refrigerant.

To drive the compressor 108, the system 100 includes a motor or drive mechanism 152. While the term "motor" is used with respect to the drive mechanism for the compressor 108, it is to be understood that the term "motor" is not limited to a motor but is intended to encompass any component that can be used in conjunction with the driving of the compressor 108, such as a variable speed drive and a motor starter. In a preferred embodiment of the present invention, the motors or drive mechanism 152 is an electric motor and associated components. However, other drive mechanisms such as steam or gas turbines or engines and associated components can be used to drive the compressor 108.

Figure 3:
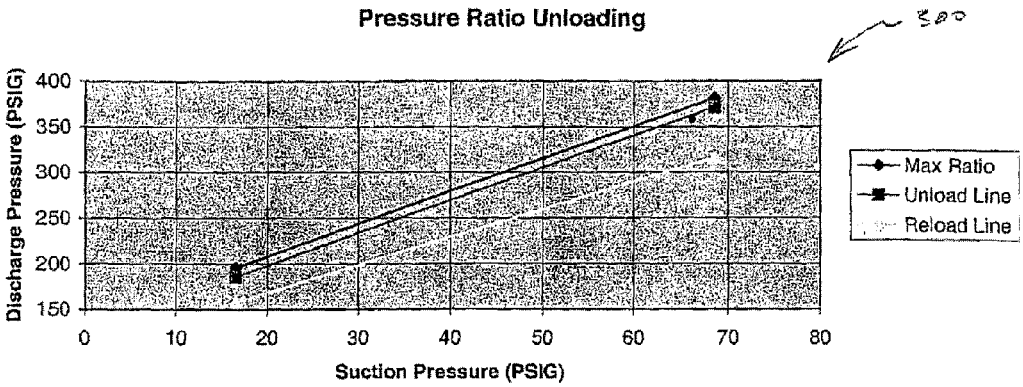
FIG. 3 illustrates a graph of the discharge pressure with relative to suction pressure.

The microprocessor 150 of system 100 determines the maximum allowable discharge pressure for a compressor in response to a given suction pressure, by referencing a table or data map stored in the non-volatile memory 144, or in the microprocessor 150 volatile memory or RAM (not shown). The table or data map 300, which is illustrated in FIG. 3, contains a linear profile which defines the maximum pressure ratio between the discharge and suction pressure of a given compressor. The profile is a function of the specific compressor and is typically provided by the compressor manufacturer. The maximum pressure ratio line 302 indicates the compressor maximum rated discharge pressure $P_{max}$, as a function of the compressor suction pressure $P_{CS}$, over a range of suction pressure values 304. The maximum operating discharge pressure (or the unloading pressure), $P_{UN}$ is a pressure less than $P_{max}$ that provides sufficient safety margin for the system to unload in response to rising pressure at the compressor discharge, before the compressor discharge pressure reaches the maximum pressure ratio line 302. Preferably, $P_{UN}$ is determined by subtracting a predetermined pressure, for example, 10 PSIG, from the maximum rated discharge pressure $P_{max}$ specified by the compressor manufacturer for the compressor 108. The unload line 306 is thus a line segment running parallel to the maximum pressure ratio line 302 on a graph of the table 300. Alternately, $P_{UN}$ may be calculated as a percentage of $P_{max}$. Another line 308 on the table 300 indicates a reload compressor discharge pressure $P_{RE}$ that is sufficiently below the unload pressure 306 corresponding to the measured parameter, the compressor suction pressure 304, to allow reloading of the compressor. Preferably, the reload line pressure $P_{RE}$ is a predetermined percentage, for example, about 85%, of the maximum operating compressor discharge pressure $P_{UN}$, for the measured suction pressure $P_{CS}$.

When the discharge pressure $P_{CD}$ of the compressor exceeds the maximum operating discharge pressure $P_{UN}$ for the corresponding suction pressure $P_{CS}$, the microprocessor 150 sends a signal via interface board 146 to unload the compressor. After a predetermined time period has elapsed, e.g., 10 minutes, the discharge pressure and the suction pressure of the compressor 108 are measured again. If after the time period has elapsed, the compressor discharge pressure $P_{CD}$, is below the reload pressure $P_{RE}$ for the compressor suction pressure $P_{CS}$, the compressor may be reloaded. The system does not reload the compressor 108, however, unless required to satisfy cooling demand.

The system 100 includes a sensor 160 for sensing the discharge pressure of compressor 108, and a sensor 164 for sensing the suction line pressure. The sensor 160 is preferably in the main refrigerant line 110 at the discharge outlet of the compressor 108, or at the intake to the condenser 112. However, the sensor 160 can be placed in any location that provides an accurate measurement of the discharge pressure. A signal, either analog or digital, corresponding to the discharge pressure is then transmitted via wireless transmission or signal cable 162 from the sensor 160 to the control panel 140. In another embodiment of the present invention, the sensor 160 can measure any suitable parameter, e.g., the temperature of the refrigerant, that is related to the discharge pressure.

If necessary, the signal input to control panel 140 over signal cable 162 is converted to a digital signal or word by A/D converter 148. The digital signal (either from the A/D converter 148 or from the sensor 160) is then input into the control algorithm, which is described in more detail in the following paragraphs, to generate a control signal for the compressor. In another embodiment of the present invention, in lieu of the sensor 160 measuring the discharge pressure, another appropriate parameter is measured by the sensor 160, such as condenser temperature or pressure, is input into the control algorithm. The control signal for unloading or loading the compressor 108 is provided to the interface board 146 of the control panel 140 by the microprocessor 150, as appropriate, after executing the control algorithm. The interface board 146 then provides the control signal to the compressor 108 to unload or reload system capacity. In yet another embodiment of the present invention, a differential pressure sensor is used to measure the discharge pressure.

Microprocessor 150 uses a control algorithm to determine when to unload or reload the compressor 108 by operation of inlet guide vanes or valves (not shown), such as capacity plug valves, slide valves, or other capacity valves in the system 100. Unloading the compressor may involve turning off or on one of several other parallel compressors as well. In one embodiment, the control algorithm can be a computer program having a series of instructions executable by the microprocessor 150. The control algorithm determines, after comparing the compressor discharge pressure ratio with the maximum operating pressure ratio, whether to unload the compressor of the system 100 or whether to keep the system 100 in its current operating state. While it is preferred that the control algorithm be embodied in a computer program(s) and executed by the microprocessor 150, it is to be understood that the control algorithm may be implemented and executed using digital and/or analog hardware by those skilled in the art. If hardware is used to execute the control algorithm, the corresponding configuration of the control panel 140 can be changed to incorporate the necessary components and to remove any components that may no longer be required, e.g., the A/D converter 148.

In addition to using the control algorithm to determine whether to unload the compressor 108 of the system 100 when the discharge pressure is approaching the maximum rated pressure ratio, the microprocessor 150 also executes additional control algorithms to control the "steady state" or normal operation of the system 100, i.e., the discharge pressure or other related parameter is maintained in a range about a predetermined setpoint to satisfy load demands while staying below the maximum allowed discharge pressure.

Figure 2:
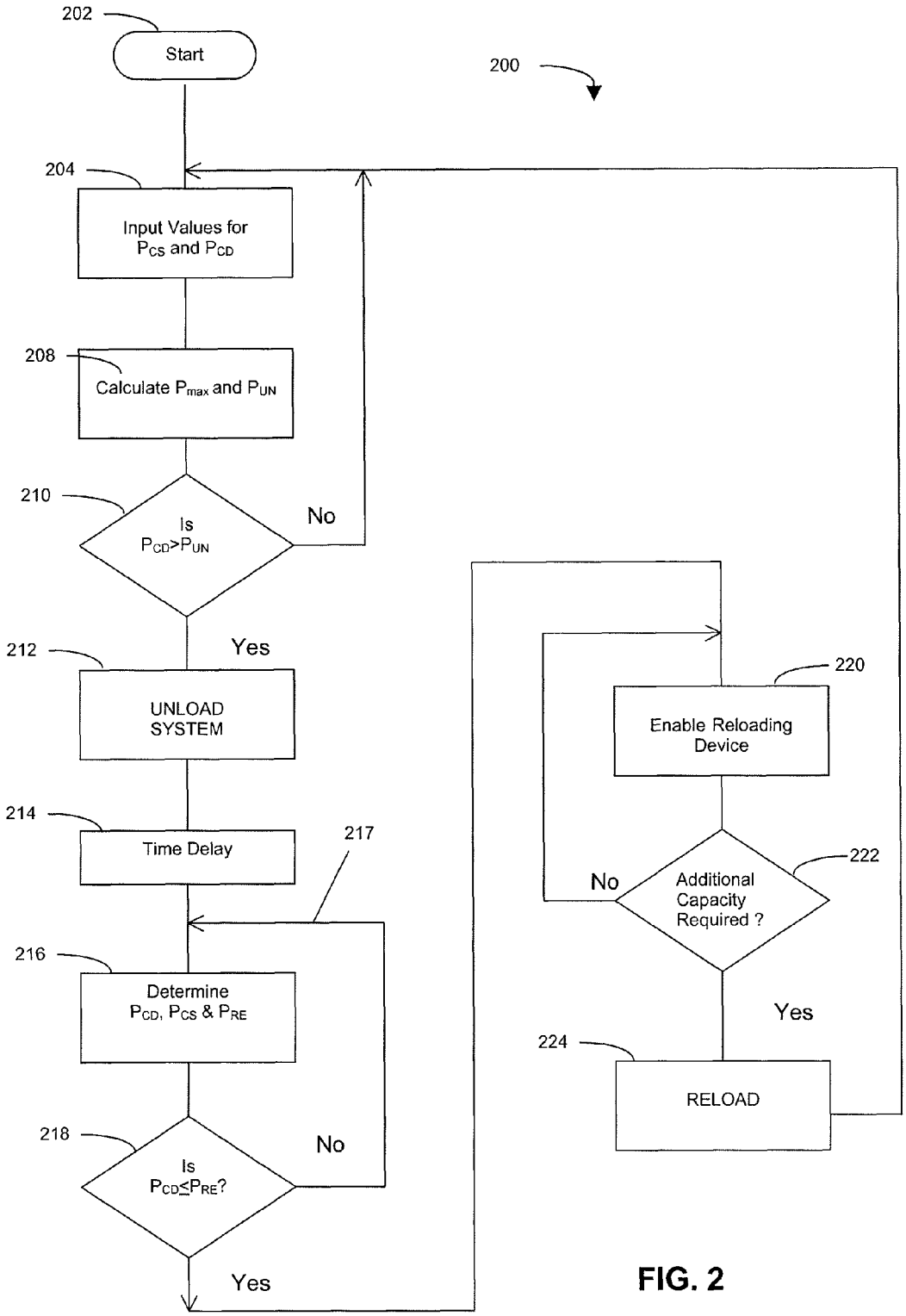
FIG. 2 illustrates a flow chart of one embodiment of the present invention.

FIG. 2 illustrates a control algorithm of the present invention for determining whether to unload or reload the system based on the pressure ratio. The process for determining when to unload or reload a compressor 108 is described in the context of the refrigeration system 100 illustrated in FIG. 1, however, it is to be understood that the process can also be applied to a multiple compressor system, including a system with two or more compressors.

In response to the activation or starting of the system 100 from an idle or off state, the process begins by activating or starting the compressor 108 at step 202. It is to be understood that the steady state or normal loaded operating condition for the compressor 108 is different from the steady state operation of the system 100 discussed above. In one embodiment, the compressor 108 may be considered to be in a normal loaded operating state or condition upon the expiration of an optional "warm-up" time period. Regardless of whether a warm-up period is used, the pressure ratio of the compressor is controlled so as not to exceed the maximum pressure ratio. The warm-up time period for the compressor 108 can range up to 5 minutes if desired, but may be any suitable time period for the compressor 108 to reach a normal loaded operating state.

In an alternate embodiment, if the compressor 108 has not reached a normal loaded operating state the process returns to the warm-up (possibly with a time delay) and the compressor 108 is again evaluated to determine if the compressor 108 has reached a normal loaded operating state.

In another embodiment of the present invention, the compressor 108 can be determined to be in a normal loaded operating state by measuring an operating parameter of the compressor 108 instead of waiting for the expiration of the predetermined time period. For example, the amount of motor current used by the compressor motor or the positioning of any pre-rotation vanes of the compressor 108 can be measured and used to determine that the compressor 108 has reached a normal loaded operating state. The compressor can be considered to be operating in a normal loaded operating state when the measured motor current is equal to or greater than a predetermined current level, e.g. 100% of the full load current or the allowable motor current, or when the measured position of the pre-rotation vanes is equal to or more open than a predetermined position, e.g., a fully open position.

Once the compressor 108 has reached a normal loaded operating state, the compressor discharge pressure $P_{CD}$ and the compressor suction pressure $P_{CS}$ are then measured in step 204. While the measurement of $P_{CD}$ and $P_{CS}$ is preferred in step 204, it is to be understood that other parameters can be measured instead of the discharge and suction pressures, e.g. the temperature or pressure of the refrigerant in the evaporator 126 or condenser 112, and used to calculate $P_{CD}$ and $P_{CS}$.

In still another embodiment of the present invention, steady state operation check can occur after the measurement of the $P_{CD}$ and $P_{CS}$ in step 204. In this embodiment, if the compressor 108 is determined to be operating in a normal loaded operating state, the process would then continue or resume at the point immediately after where step 204 was performed. However, if the compressor 108 is not operating in a normal loaded operating state, the process would return to step 204 for another measurement of $P_{CD}$ and $P_{CS}$ and the process steps would be repeated until the compressor 108 is determined to be operating in a normal loaded operating state.

Referring again to FIG. 2, the maximum pressure ratio profile 300 (see FIG. 3) is stored in the system non-volatile memory 144 or loaded in the microprocessor 150 memory, and is accessed by the microprocessor 150. At step 204, compressor discharge pressure $P_{CD}$ and suction pressure $P_{CS}$ are input to the microprocessor 150 directly or after processing via A/D converter 148. At step 208, a maximum pressure $P_{max}$ is determined based upon the measured $P_{CS}$. The unloading pressure $P_{UN}$ is determined based on $P_{max}$. $P_{CD}$ is then compared with $P_{UN}$ in step 210. If $P_{CD}$ does not exceed $P_{UN}$, then the system remains in normal operation or its current operating state through the next iteration of the process. If, however, $P_{CD}$ exceeds $P_{UN}$, at step 210 the microprocessor 150 transmits a signal to the system to unload in step 212. After the unload signal is transmitted in step 212, a delay period is initiated at step 214. During the delay period, the pressure parameters may be updated, but no instructions to reload the system are processed. The delay period for reloading in the preferred embodiment is about 10 minutes, but may be longer or shorter, e.g., from 5 minutes to 25 minutes, depending on system response, system capacity and other requirements. At step 216, after the delay period lapses, the compressor discharge pressure $P_{CD}$ and suction pressure $P_{CS}$ are again measured, and at step 218 the system determines whether the discharge pressure $P_{CD}$ has dropped below an acceptable reloading pressure $P_{RE}$ as described above with respect to FIG. 3.

If $P_{CD}$ is greater than $P_{RE}$, then the system repeats step 216 as indicated by arrow 217. During the iteration loop indicated by arrow 217, the system may further unload the compressor, or if after a predetermined number of iterations $P_{CD}$ continues to exceed $P_{RE}$, shut down the system. If desired, a delay period (not shown) may be inserted by the microprocessor 150 during the iteration loop indicated by arrow 217, but the delay in the iteration is not required. Otherwise, when $P_{CD}$ is determined to be less than or equal to $P_{RE}$, the system proceeds to step 220. At step 220, the microprocessor 150 sends a signal to the system 100 to permit reloading of the compressor, but does not reload the compressor. At step 222, the system determines whether a capacity demand signal is present. If a capacity demand signal is received, the compressor 108 is reloaded at step 224 and the system 100 returns to normal operation. If no capacity demand signal is received at step 222, the system returns to step 220.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for controlling a discharge pressure of a compressor relative to a suction pressure of the compressor, the method comprising the steps of:

measuring a discharge pressure and a suction pressure of the compressor;

determining a predetermined maximum discharge pressure for the compressor based on the measured suction pressure, wherein the predetermined maximum discharge pressure is less than a maximum rated discharge pressure for the compressor;

comparing the measured discharge pressure with the predetermined maximum discharge pressure;

unloading the compressor in response to the measured discharge pressure exceeding the predetermined maximum discharge pressure; and after unloading the compressor, enabling reloading of the compressor in response to the measured discharge pressure being less than a predetermined reload pressure for the compressor, the predetermined reload pressure being based on the measured suction pressure.

2. The method as set forth in claim 1, wherein the method further comprises the steps of:

repeating the step of measuring the discharge pressure and suction pressure after unloading the compressor;

preventing the compressor from being reloaded for a predetermined time delay in response to unloading the compressor;

comparing the measured discharge pressure after unloading the compressor to the predetermined reload pressure; and reloading the compressor after the predetermined time delay has elapsed in response to a demand for additional capacity and the measured discharge pressure after unloading the compressor being less than the predetermined reload pressure.

3. The method set forth in claim 2, wherein the predetermined reload pressure is less than the predetermined maximum discharge pressure.

4. The method set forth in claim 3, wherein the predetermined reload pressure is a predetermined percentage of the predetermined maximum discharge pressure for the measured suction pressure.

5. The method set forth in claim 4, wherein the predetermined percentage is about 85%.

6. The method set forth in claim 2, also including the step of, before unloading the compressor, waiting a predetermined time period for the compressor to achieve a normal operating state.

7. The method set forth in claim 6, wherein the predetermined time period is in the range from 0 minutes to about 5 minutes.

8. The method set forth in claim 2, wherein the predetermined maximum discharge pressure is defined by a linear profile of the compressor discharge pressure relative to the compressor suction pressure, the linear profile being provided as a function of the compressor, a maximum rated discharge pressure line defines the maximum rated discharge pressure of the compressor as a function of the suction pressure of the compressor over an operative range of suction pressure values.

9. The method set forth in claim 8, wherein the predetermined maximum discharge pressure is defined as a predetermined pressure differential below the maximum rated discharge pressure defined by the maximum rated discharge pressure line.

10. The method set forth in claim 9, wherein the predetermined pressure differential is about 10 PSIG.

11. The method set forth in claim 8, wherein the predetermined maximum discharge pressure is defined as a predetermined percentage of the maximum rated discharge pressure.

12. In a chiller system including a compressor, a condenser, and an evaporator connected in a closed refrigerant loop, and a control panel to control operation of the chiller system, a method of controlling a discharge pressure of the compressor including the steps of:

providing a set of maximum compressor discharge pressure values for corresponding suction pressure values, wherein the maximum compressor discharge pressure value is less than a maximum rated discharge pressure value for a corresponding suction pressure value;

determining a compressor suction pressure;

determining a compressor discharge pressure;

unloading the compressor for at least a predetermined interval when the determined compressor discharge pressure is greater than the maximum compressor discharge pressure for the determined compressor suction pressure;

initiating a compressor reloading process in response to unloading the compressor and receiving a demand for capacity, the compressor reloading process including the steps of:

providing a set of compressor reload discharge pressure values for corresponding compressor suction pressure values;

waiting a predetermined interval;

determining an unloaded compressor discharge pressure and an unloaded compressor suction pressure after unloading the compressor;

comparing the compressor reload discharge pressure value with the determined unloaded compressor discharge pressure for the determined unloaded compressor suction pressure;

waiting another predetermined interval when the determined unloaded compressor discharge pressure is greater than the reload pressure value for the determined unloaded compressor suction pressure; and reloading the compressor when the determined unloaded compressor discharge pressure is less than or equal to the reload pressure value for the determined unloaded compressor suction pressure.

13. The method of claim 12, wherein the compressor is a compressor type selected from the group consisting of centrifugal, screw, reciprocating, scroll and rotary compressors.

14. The method set forth in claim 12, wherein the compressor discharge pressure is determined by sensing any suitable parameter related to the discharge pressure.

15. The method set forth in claim 12, wherein the compressor discharge pressure is determined by sensing one of a condenser temperature or a condenser pressure, and the condenser temperature or condenser pressure is input into a control algorithm implemented by a microprocessor in the control panel.

16. The method set forth in claim 12, wherein the system includes a plurality of compressors.

17. The method set forth in claim 12, wherein the system also includes a microprocessor in the control panel to implement a control algorithm to unload or reload the compressor, and wherein unloading and reloading are achieved by controlling an inlet guide vanes or one of a plurality of capacity valves in the system.

18. The method set forth in claim 17, wherein the microprocessor also executes control algorithms to control the normal operation of the system by maintaining the compressor discharge pressure within a predetermined range about a predetermined setpoint to satisfy load demands, and maintaining the compressor discharge pressure below the maximum allowed discharge pressure.

19. A computer program product implemented on a non-transitory computer readable medium and executable by a microprocessor for determining when to unload a compressor in a chiller system, the computer program product comprising computer instructions for executing the steps of:

measuring a discharge pressure and a suction pressure of the compressor;

determining a predetermined maximum discharge pressure for the compressor based on the measured suction pressure, wherein the predetermined maximum discharge pressure is less than a maximum rated discharge pressure ratio for the compressor;

comparing the measured discharge pressure with the predetermined maximum discharge pressure;

unloading the compressor in response to the measured discharge pressure exceeding the predetermined maximum discharge pressure; and after unloading the compressor, enabling reloading of the compressor in response to the measured discharge pressure being less than a predetermined reload pressure for the compressor, the predetermined reload pressure being based on the measured suction pressure.

20. The method as set forth in claim 19, wherein the computer program product further comprises computer instructions for executing the steps of: repeating the step of measuring the discharge pressure and suction pressure after unloading the compressor; preventing the compressor from being reloaded for a predetermined time delay in response to unloading the compressor; comparing the measured discharge pressure after unloading the compressor to the predetermined reload pressure; and reloading the compressor after the predetermined time delay has elapsed in response to a demand for additional capacity and the measured discharge pressure after unloading the compressor being less than the predetermined reload pressure.

* * * * *